US005325959A

United States Patent [19]

Goldberger

[11] Patent Number: 5,325,959

[45] Date of Patent: Jul. 5, 1994

[54] BOOKMARK EYEGLASS CASE COMBINATION

[76] Inventor: Irwin Goldberger, 991 Benton St., Woodmere, N.Y. 11598

[21] Appl. No.: 36,713

[22] Filed: Mar. 25, 1993

[51] Int. Cl.[5] ..... A45C 11/04

[52] U.S. Cl. ..... 206/5; 206/38; 206/472; 281/42; 224/901

[58] Field of Search ..... 206/5, 38, 472, 473; 224/252, 253, 901; 281/42

[56] References Cited

U.S. PATENT DOCUMENTS

| | | | |
|---|---|---|---|
| D. 325,929 | 5/1992 | Larson et al. . | |
| 1,842,599 | 1/1932 | Fraser | 206/5 R |
| 2,300,216 | 10/1942 | Grodsky et al. . | |
| 2,557,552 | 6/1951 | Martin | 206/5 |
| 2,777,489 | 1/1957 | Stegeman | 206/5 R |
| 3,949,916 | 4/1976 | Yount | 224/253 |
| 4,162,800 | 7/1979 | Gonot, Jr. et al. . | |
| 4,267,923 | 5/1981 | Baratelli et al. | 206/5 |
| 4,500,019 | 2/1985 | Curley, Jr. | 224/901 |
| 4,732,107 | 3/1988 | Jacobsen . | |
| 4,819,846 | 4/1989 | Hannemann | 224/901 |
| 4,986,572 | 1/1991 | Kuykendall | 281/42 |
| 5,020,711 | 6/1991 | Kelley | 224/901 |
| 5,054,816 | 10/1991 | Rosengarten | 281/42 |
| 5,170,917 | 12/1992 | Tourigny | 224/901 |
| 5,213,241 | 5/1993 | Dewar et al. | 206/5 |

*Primary Examiner*—David T. Fidei
*Attorney, Agent, or Firm*—Collard & Roe

[57] ABSTRACT

A bookmark strap fits through a book and has one end connected to an eyeglass case. At the other end of the bookmark are VELCRO® circular patches so that when the bookmark strap is placed onto the page where a reader has stopped reading, the rest of the extended length of the bookmark strap can be wrapped around to the front of the book and be connected to the back of the eyeglass case to a corresponding VELCRO® patch. This will lock the bookmark and eyeglass case around the book, with the eyeglass case conveniently positioned on the top cover page of the book.

18 Claims, 1 Drawing Sheet

38
28
24
30

10
28
24
32
50

26
36
12
16
22
L
28
38
40
42
44
30
24
l
X
14
12
B
A 22
16
W
24
12
50
52
B
54

BOOKMARK EYEGLASS CASE COMBINATION

BACKGROUND OF THE INVENTION

1. Field of the Invention

The present invention relates to a combination bookmark eyeglass case in which a bookmark strap fits around and through a book, with one end of the strap permanently fastened to one end of an eyeglass case and the other end of the strap releasably attached to another end of the eyeglass case.

2. The Prior Art

The Gonot, Jr. U.S. Pat. No. 4,162,800 discloses the combination of an elastic bookmark and a holder for writing instruments which permits the bookmark to be attached to a variety of different books, and which will also releasably hold a writing instrument. The bookmark consists of a loop of elastic material which may be either seamless or it may be joined together with a seam.

This reference, however, fails to show an eyeglass case in combination with the bookmark, whereby it would be possible to adjust the length of the bookmark very substantially. In addition, Gonot does not suggest that the use of a holder could also function as part of the adjustable attachment means.

The Jacobsen U.S. Pat. No. 4,732,107 shows a removable page marker for a book.

The Grodsky U.S. Pat. No. 2,300,216 shows a combination bookmark and pencil holder which merely rests in between the pages of the book and does not actually fold completely around and encase the book.

The Larson Design U.S. Pat. No. 325,929 shows a design for a combination bookmark and pencil holder which is similar to Grodsky as discussed above.

SUMMARY OF THE INVENTION

It is an object of the present invention to provide a bookmark in combination with an eyeglass case, wherein the bookmark and the eyeglass case also function as part of an adjustable fastener combination.

The above object is accomplished in accordance with the present invention by providing a bookmark and eyeglass case combination comprising an eyeglass case having an open end and a closed end, with a top side extending between the open end and the closed end, and with a bottom side extending between the open end and the closed end. There is an eyeglass case attachment means on the eyeglass case for releasably attaching the eyeglass case to a bookmark. Also, there is a bookmark having a first end and a second end, with a top surface extending between the first end and the second end, and with a bottom surface extending between the first end and the second end. There is a bookmark attachment means on the bookmark for releasably attaching the bookmark to the eyeglass case attachment means, and there is a means for releasably or permanently fastening the first end of the bookmark to an end of the eyeglass case.

The present invention is directed to a bookmark strap that fits around and through a book and has one end that is releasably or permanently connected to an eyeglass case. At the end of the eyeglass case is a releasable attachment means such as a VELCRO® patch (i.e., hook and loop type fastener) or a snap. At the other end of the bookmark strap are various VELCRO® patches or snaps that are aligned in tandem with each other in such a way that when the VELCRO® hook, or the snap on the eyeglass case is brought into contact with the wrapped around strap of the bookmark, it is possible to adjust the overall length of the bookmark based upon the particular VELCRO® patch or snap to which the VELCRO® is meshed or the snap is connected.

Hence, it is possible to adjust the overall circular length of the bookmark to accommodate books of various dimensions, lengths and thicknesses, depending on the number of pages necessary to encompass. In other words, when the bookmark is placed around the outside of the book after the reader has stopped reading, the length of the bookmark is adjustable so that when it is wrapped around the front of the book and comes into contact with the eyeglass case to mesh with the corresponding VELCRO® hook or snap, the eyeglass case will always be snugly resting and held conveniently in place on the outside top cover of the book.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figures 1, 2, 3, 4:
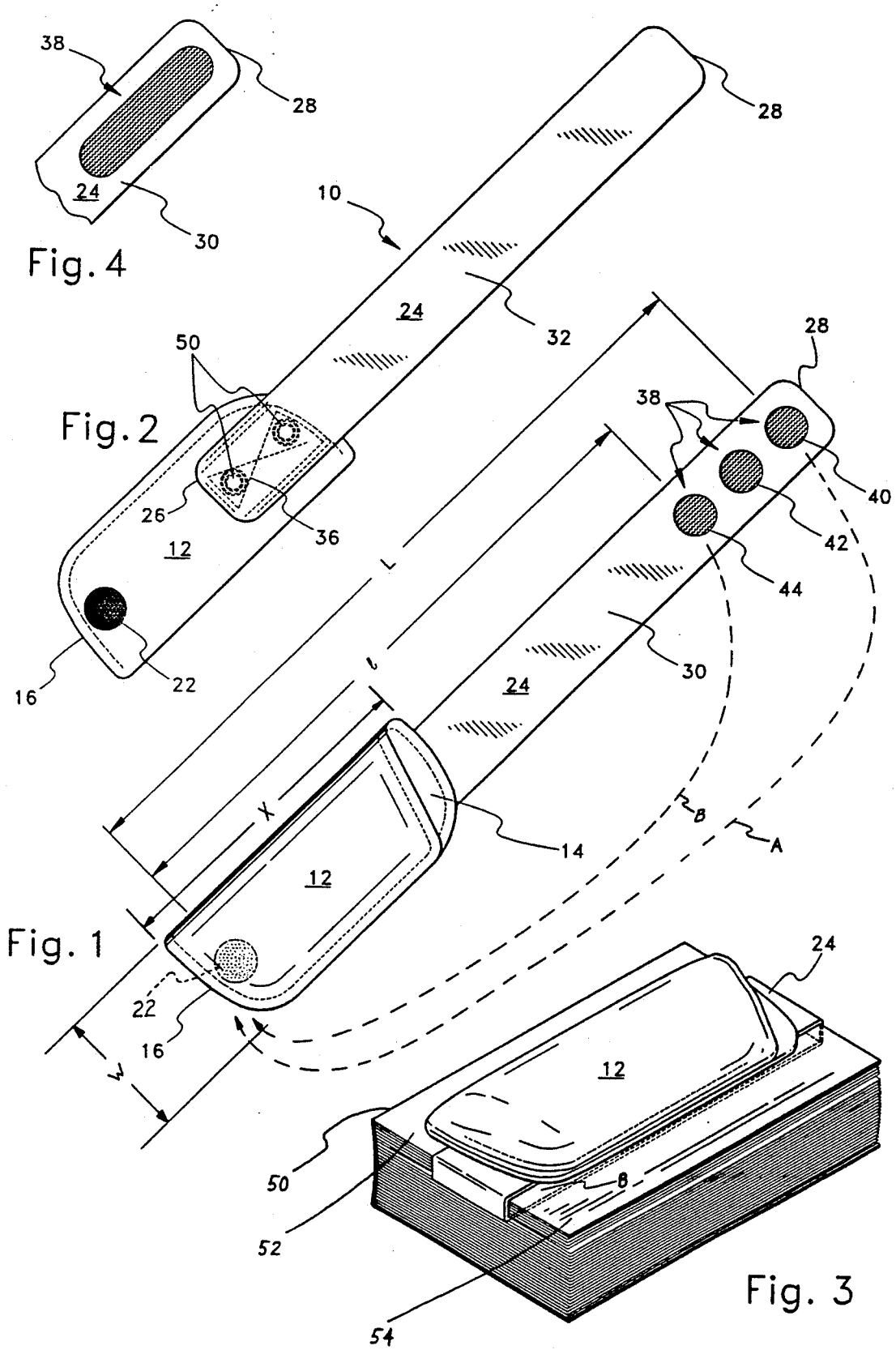
FIG. 1 is a top view of the combination of the present invention showing the top side of the eyeglass case and the top surface of the bookmark having bookmark attachment means thereon.
FIG. 2 is a bottom view of the combination of FIG. 1 showing the bottom side of the eyeglass case having attachment means thereon and the bottom surface of the bookmark.
FIG. 3 shows a perspective view of the eyeglass case held in place on the outside top cover of a book by the bookmark strap.
FIG. 4 shows a single bookmark attachment means.

Turning now in detail to the drawings, FIGS. 1 and 2 show a bookmark and eyeglass case combination 10 including an eyeglass case 12 having an open end 14 and a closed end 16, with a length x extending from open end 14 to closed end 16 and a width w whereby length x is greater than width w, with a top side 18 (FIG. 1) extending between the open end 14 and the closed end 16, and with a bottom side 20 (FIG. 2) extending between the open end 14 and the closed end 16. An eyeglass case attachment means 22 is located on the eyeglass case 12 at the closed end 16 for releasably attaching the eyeglass case to a bookmark 24. The eyeglass case is usually made by known construction and can be composed of a thermoplastic material such as polyvinyl chloride, or of a composite laminate of several different plastic materials bonded together. A pair of eyeglasses (not shown) may be inserted into, or withdrawn from, the open end 14 of the case 12.

The bookmark 24 has a first end 26 and a second end 28, with a top surface 30 extending between the first end 26 and the second end 28, and with a bottom surface 32 extending between the first end 26 and the second end 28. The bookmark is usually made by known construction and is usually composed of a thermoplastic material such as polyvinyl chloride, or of a composite laminate of several different plastic materials bonded together.

A bookmark attachment means 38 is located on the second end 28 of the bookmark for releasably attaching the bookmark 24 to the eyeglass case attachment means 22. Fastener means 36 may releasably or permanently fasten the first end 26 of the bookmark 24 to the open end or the closed end of the eyeglass case 12. Preferably, the bookmark first end 26 is fastened to the bottom side 20 at the open end 14 of the eyeglass case 12.

In one embodiment, the eyeglass case attachment means 22 is located on the bottom side 20 of the eyeglass case 12 adjacent to the closed end 16 of the eyeglass case. The bookmark attachment means 38 is located on the top surface 30 of the bookmark 24 adjacent to the second end 28 of the bookmark.

In a further embodiment, the eyeglass case attachment means and the bookmark attachment means could be transposed in location. Thus, the eyeglass case attachment means 22 could be located on the bookmark at end 28, where the bookmark attachment means 38 is now positioned, as shown in FIG. 1. Then the bookmark attachment means 40, 42 and 44 could be transposed and relocated onto the eyeglass case at end 16, where the eyeglass case attachment means 22 is now positioned, as shown in FIG. 2.

The fastening means 36 can releasably fasten or can permanently fasten the first end 26 of the bookmark to the open end 14 of the eyeglass case 12. As shown in FIG. 2, means 36 preferably is made of any known type of permanent fastener, such as stitching with thread, staples, brackets or clips. In another embodiment, this fastener at end 26 can be snaps 50 for releasibly fastening the first end 26 of the bookmark to open end 14 of the eyeglass case.

In a further embodiment, the eyeglass case attachment means 22 and the bookmark attachment means 38 are the two component parts of a VELCRO® hook-and-loop type of fastener, which are preferably shaped as circular patches. As shown in FIG. 1, the bookmark attachment means 38 includes a series of linearly aligned attachment elements 40, 42 and 44 including a first attachment element 40 adjacent to the second end 28 of the bookmark 24 and a last attachment element 44 farthest removed from the second end 28 of the bookmark and closest to the first end 26 of the bookmark. Intermediate attachment element 42 is located between the first and the last attachment elements. Preferably, each element 40, 42 or 44 is a VELCRO® circular patch.

In another embodiment, means 22 and means 38 can be the two component parts of a matingly engageable pair of snaps (not shown).

In a further embodiment, the bookmark attachment means 38*a*, shown in FIG. 4, is a simple VELCRO® patch having a width equal to the diameter of circular patch 40 and having a length equal to the total distance between patch 40 and patch 44 measured as the distance between length L minus length 1, plus the diameter of one of the patches 40, 42 or 44.

According to the present invention, when the combination bookmark eyeglass case 10 is placed around the outside of a book 50, as shown in FIG. 3, bookmark 24 encircles a plurality of pages 52 in addition to the outside top cover 54 of the book, such that eyeglass case 12 snugly rests on the encircled cover 54 and bookmark 24 encloses the plurality of pages of the book parallel to the bottom side 20 of the eyeglass case.

According to the present invention, the combination 10 bookmark and eyeglass case has a maximum circumferential length L and has a minimum circumferential length 1. Thus, whenever the first attachment element 40 of the bookmark attachment means 38 is releasably attached to the eyeglass case attachment means 22, then this combination 10 has a maximum circumferential length L. This maximum circumferential length will be produced by folding the bookmark second end 28 along the circular path (A) illustrated in FIG. 1.

Hence, whenever the last attachment element 44 of the bookmark attachment means 38 is releasably attached to the eyeglass case attachment mean 22, then this combination 10 has a minimum circumferential length 1. This minimum circumferential length 1 will be produced by folding the bookmark second end 28 along the circular path (B) illustrated in FIG. 1. Thus, by adjusting the circumferential length, it is possible to adjust the combination bookmark and eyeglass case to encompass different sized books, or to surround different numbers of pages being marked within the same book.

In a further embodiment, the combination 10 also has an intermediate circumferential length, based upon attaching the intermediate attachment element 42 to the eyeglass case attachment means 22.

These features enable the bookmark eyeglass case together to have the advantages that they can function as an adjustable fastener combination, in addition to being a bookmark and a housing for a book reader's pair of glasses.

While several embodiments of the present invention have been shown and described, it is to be understood that many changes and modifications may be made thereunto without departing from the spirit and scope of the invention as defined in the appended claims.

What is claimed is:

1. A bookmark and eyeglass case in combination with a book, said book having an outside top cover comprising:

an eyeglass case having an open end and a closed end, with a length and a width, said length being a distance between said open end and said closed end with said length being greater than said width, with a top side extending between said open end and said closed end, and with a bottom side extending between said open end and said closed end;

an eyeglass case attachment means on said eyeglass case for releasably attaching said eyeglass case to a bookmark;

a bookmark having a first end and a second end, with a top surface extending between said first end and said second end, and with a bottom surface extending between said first end and said second end;

a bookmark attachment means on said bookmark for releasably attaching said bookmark to said eyeglass case attachment means; and means for fastening said first end of said bookmark to an end of said eyeglass case so that the bookmark extends along the length of the eyeglass case;

wherein said eyeglass case is held in place on the outside top cover of the book.

2. The combination according to claim 1, wherein said eyeglass case attachment means is located on the bottom side of said eyeglass case adjacent to said closed end of said eyeglass case.

3. The combination according to claim 1, wherein said bookmark attachment means is located on the top surface of said bookmark adjacent to said second end of said bookmark.

4. The combination according to claim 1, wherein said means for fastening, permanently fastens said first end of said bookmark to said open end of said eyeglass case.

5. The combination according to claim 1, wherein said means for fastening releasably fastens said first end of said bookmark to said open end of said eyeglass case.

6. The combination according to claim 1, wherein said eyeglass case attachment means and said bookmark attachment means are two component parts of a hook-and-loop type of fastener.

7. The combination according to claim 1, wherein said bookmark attachment means comprises a series of linearly aligned attachment elements including a first attachment element adjacent to said second end of the bookmark and a last attachment element farthest removed from the second end of said bookmark and closest to the first end of the bookmark.

8. The combination according to claim 7, wherein said combination has a maximum circumferential length and has a minimum circumferential length;

and whenever said first attachment element of said bookmark attachment means is releasably attached to said eyeglass case attachment means, said combination has said maximum circumferential length.

9. The combination according to claim 8, wherein, whenever said last attachment element of said bookmark attachment means is releasably attached to said eyeglass case attachment means, said combination has said minimum circumferential length.

10. A bookmark and eyeglass case in combination with a book, said book having a plurality of pages disposed between the covers of said book, said combination comprising:

an eyeglass case having an open end and a closed end, with a top side extending between said open end and said closed end, and with a bottom side extending between said open end and said closed end;

an eyeglass case attachment means on said eyeglass case for releasably attaching said eyeglass case to a bookmark;

a bookmark having a first end and a second end, with a top and bottom surface both extending between said first end and said second end;

a bookmark attachment means on said bookmark for releasably attaching said bookmark to said eyeglass case attachment means after said bookmark encircles a plurality of pages and one of the book covers; and means fastening said first end of said bookmark to an end of said eyeglass case, such that said eyeglass case rests on said one of said covers of said book and said bookmark lies within said plurality of pages parallel to the bottom side of said eyeglass case.

11. The combination according to claim 10, wherein said eyeglass case attachment means is located on the bottom side of said eyeglass case adjacent to said closed end of said eyeglass case.

12. The combination according to claim 10, wherein said bookmark attachment means is located on the top surface of said bookmark adjacent to said second end of said bookmark.

13. The combination according to claim 10, wherein said means for fastening, permanently fastens said first end of said bookmark to said open end of said eyeglass case.

14. The combination according to claim 10, wherein said means for fastening releasably fastens said first end of said bookmark to said open end of said eyeglass case.

15. The combination according to claim 10, wherein said eyeglass case attachment means and said bookmark attachment means are two component parts of a hook-and-loop type of fastener.

16. The combination according to claim 10, wherein said bookmark attachment means comprises a series of linearly aligned attachment elements including a first attachment element adjacent to said second end of the bookmark and a last attachment element farthest removed from the second end of said bookmark and closest to the first end of the bookmark.

17. The combination according to claim 16, wherein said combination has a maximum circumferential length and has a minimum circumferential length;

and whenever said first attachment element of said bookmark attachment means is releasably attached to said eyeglass case attachment means, said combination has said maximum circumferential length.

18. The combination according to claim 17, wherein, whenever said last attachment element of said bookmark attachment means is releasably attached to said eyeglass case attachment means, said combination has said minimum circumferential length.

* * * * *